US005291578A

United States Patent [19]

Kalami

[11] Patent Number: 5,291,578

[45] Date of Patent: Mar. 1, 1994

[54] APPARATUS FOR CONTROLLING A VEHICLE FUEL PUMP

[75] Inventor: Hoshmand Kalami, Novi, Mich.

[73] Assignee: First Switch, Inc., Grand Blanc, Mich.

[21] Appl. No.: 898,521

[22] Filed: Jun. 15, 1992

[51] Int. Cl.[5] ..... F02M 37/08

[52] U.S. Cl. ..... 388/831; 123/497; 318/375

[58] Field of Search ..... 318/375, 376, 380, 430, 318/431, 432, 433, 445, 599; 388/804, 811, 819, 829, 831; 123/495, 497

[56] References Cited

U.S. PATENT DOCUMENTS

| | | | |
|---|---|---|---|
| 3,582,747 | 6/1971 | Kearns | 318/443 X |
| 4,271,383 | 6/1981 | Endo | 318/375 |
| 4,403,177 | 9/1983 | Weber et al. | 318/254 |
| 5,044,344 | 9/1991 | Tuckey et al. | 123/497 |
| 5,055,758 | 10/1991 | Hock | 318/645 |
| 5,092,302 | 3/1992 | Mohan | 123/497 |

*Primary Examiner*—Bentsu Ro
*Attorney, Agent, or Firm*—William J. Clemens

[57] ABSTRACT

A controller for a vehicle fuel pump electric motor is connected to one or more vehicle sensors for sensing fuel flow demand and pulse width modulating the motor to control the speed. A fuel demand sensor and a triangle generator are connected to a summing controller for generating a pulse width modulated control signal to a driver. The driver has a pair of outputs for generating a pair of complementary pulse width modulated switch signals to a pair of switches whereby the switches are switched on and off alternately. One of the switches is connected in series between a power supply and the motor armature and the other switch is connected across the armature. A crash sensor, such as an inertia switch, is connected to the summing controller for terminating pulse width modulation in the event of a crash. The switch connected across the armature can be turned on to short circuit the armature and quickly stop the motor in the event of a crash.

15 Claims, 2 Drawing Sheets

APPARATUS FOR CONTROLLING A VEHICLE FUEL PUMP

BACKGROUND OF THE INVENTION

The present invention relates generally to an apparatus for controlling a vehicle fuel pump and, in particular, to a vehicle fuel pump controller responsive to sensed vehicle conditions such as fuel demand.

As electrical and electronics components are added to vehicles, the increased electrical load is taxing the design limits of the vehicle electrical systems. Furthermore, federal and state legislation has mandated standards for reduced fuel vapor loss and fuel consumption in vehicles. Thus, automotive electrical system designers are searching for ways to increase the efficiency of the electrical components of the vehicles thereby reducing the power requirements.

The electric fuel pump consumes a relatively large amount of power from the vehicle electrical system. In order to assure a sufficiently high fuel pressure and fuel flow at the fuel injectors, fuel pumps currently used in vehicles are designed to produce a relatively constant fifty to one hundred pounds per square inch pressure with a return line and a pressure regulator to return the excess fuel to the fuel tank. Such a fuel system has two undesirable effects. One is that the returned fuel has passed through the hot environment of the engine compartment and, therefore, this heating effect increases the vapor generation in the fuel tank. The second effect is that the fuel pump consumes a relatively large amount of power, for example one hundred watts, constantly even though such full power is required only for a short time periods during start up and high rates of acceleration of the vehicle.

SUMMARY OF THE INVENTION

The present invention concerns an apparatus for the efficient control and operation of an electric fuel pump for a vehicle. The apparatus controls the speed, and thus the power consumption, of the fuel pump electric motor in accordance with one or more sensed conditions representing the fuel flow demand and includes the additional feature of switching off the pump in the event of a crash. The apparatus uses one or more of the existing sensors in the vehicle to calculate the fuel requirement and to pulse width control the speed of the existing fuel pump electric motor to insure that enough pressure is available to supply fuel to the fuel injectors for all fuel demand situations. Accordingly, the apparatus can save up to 50% of the power requirements of the fuel pumps currently being used in vehicles.

The apparatus controls a fuel pump electric motor powered from a direct current power source and includes a first line connected to a demand sensor for receiving a demand signal representing a fuel flow demand; a triangle generator having an output for generating a triangle shaped signal; a summing controller having a first input connected to the first line, a second input connected to the triangle generator output and an output and being responsive to the demand signal and the triangle shaped signal for generating a pulse width modulated control signal at the controller output; a driver having an input connected to the controller output and a pair of outputs and being responsive to the control signal for generating a pulse width modulated switch signal at each of the driver outputs, the switch signals being complementary; and a pair of switches each having a gate input connected to one of the driver outputs whereby the switches are switched on and off alternately in response to the switch signals.

The apparatus has an input interface circuit having an input connected to the first line and a first output connected to the summing controller first input for applying the demand signal to the controller first input. The input interface circuit has a second output and the apparatus includes a cable break detector having an input connected to the input interface circuit second output and an output connected to the first input of the summing controller. The apparatus includes a second line connected to a crash sensor for receiving a crash detection signal representing a crash condition and the summing controller has a third input connected to the second line and is responsive to the crash detection signal for terminating pulse width modulation of the control signal. The apparatus also includes a crash detection and latch circuit having a first input connected to the second line and an output and a short circuit detection circuit having a first input connected to the controller output, a second input connected to the crash detection and latch circuit output and an output connected to the driver input for applying the control signal to the driver.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
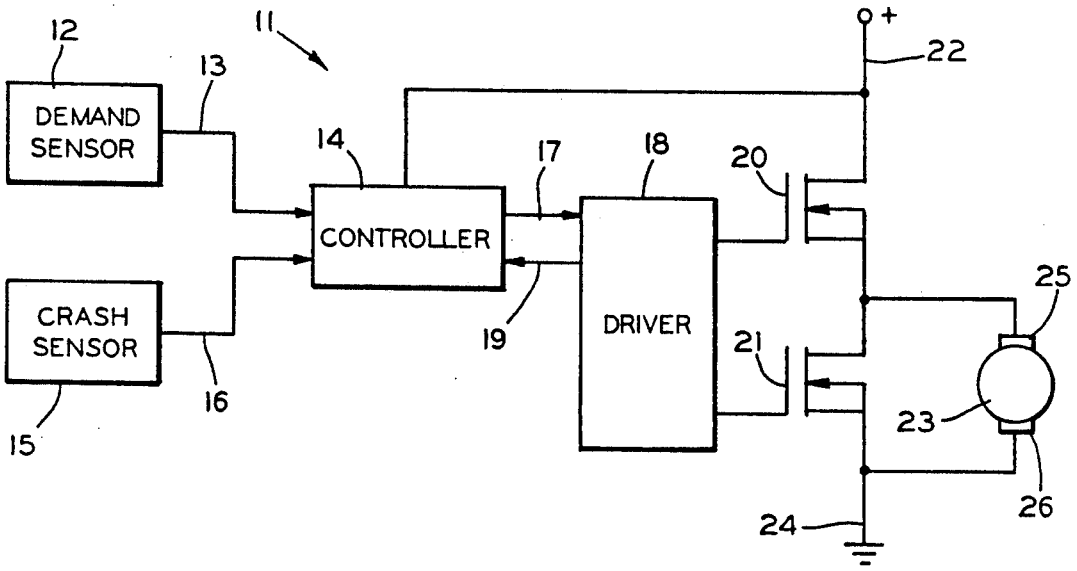
FIG. 1 is a schematic block diagram of a fuel pump controller apparatus in accordance with the present invention.

There is shown in the FIG. 1 a fuel pump control system 11 incorporating the present invention. A demand sensor 12 has an output connected by a first line 13 to a first input of a controller 14. A crash sensor 15 has an output connected by a second line 16 to a second input of the controller 14. The controller 14 has an output connected by a third line 17 to an input of a driver 18. The driver 18 has a first output connected to a third input of the controller 14 by a fourth line 19. A second output of the driver 18 is connected to a gate of a first Field Effect Transistor 20. A third output of the driver 18 is connected to a gate of a second FET 21. A power supply (not shown) has a positive polarity terminal connected to a power supply line 22 which in turn is connected to a fourth input of the controller 14 and a source terminal of the first FET 20. A drain terminal of the FET 20 is connected to a source terminal of the FET 21 and to a first terminal of a fuel pump motor 23. A drain terminal of the FET 21 and a second terminal of the motor 23 are both connected to a ground line 24 which completes the circuit with the power supply (not shown).

The fuel pump motor 23 typically is a direct current permanent magnet motor having permanent magnet field poles (not shown) and a wire wound armature connected to a commutator (not shown) in contact with a pair of brushes 25 and 26 through which electrical power is supplied to operate the motor 23. The motor 23 cannot simply be switched on for a short period of time and then switched off to control its speed. The rotational inertia of the armature during the power off period will tend to continue to rotate the armature and the motor will function as a direct current generator.

It is desirable to slow down the armature as quickly as possible to be able to linearly control the fuel pump speed and also to recover some of the back voltage generation to charge the car battery. Thus, the driver 18 and the transistors 20 and 21 function as a push pull circuit to control the pump motor 23 between a zero percent (completely off) and a one hundred percent (completely on) duty cycle for frequencies of up to one hundred KHz. The transistors 20 and 21 are relatively low resistance FETs for low power losses. Furthermore, the driver 18 generates switch signals to the gates of the transistors 20 and 21 at a relatively high current level for maximum switching speed.

In operation, the demand sensor 12 senses a condition representative of fuel flow demand and generates a demand signal. For example, the demand sensor 12 can be a mass flow sensor generating a demand signal which is proportional to the engine fuel requirement based on the flow of air into the engine. The demand sensor 12 can sense the transmission gear being utilized. The demand sensor 12 can be a crank position sensor or a sensor of spark pulses in the ignition system or any other type of speed sensor responsive to a rotating vehicle component which would generate a demand signal representative of the engine speed. The demand sensor 12 also could be a throttle position sensor.

Figure 2:
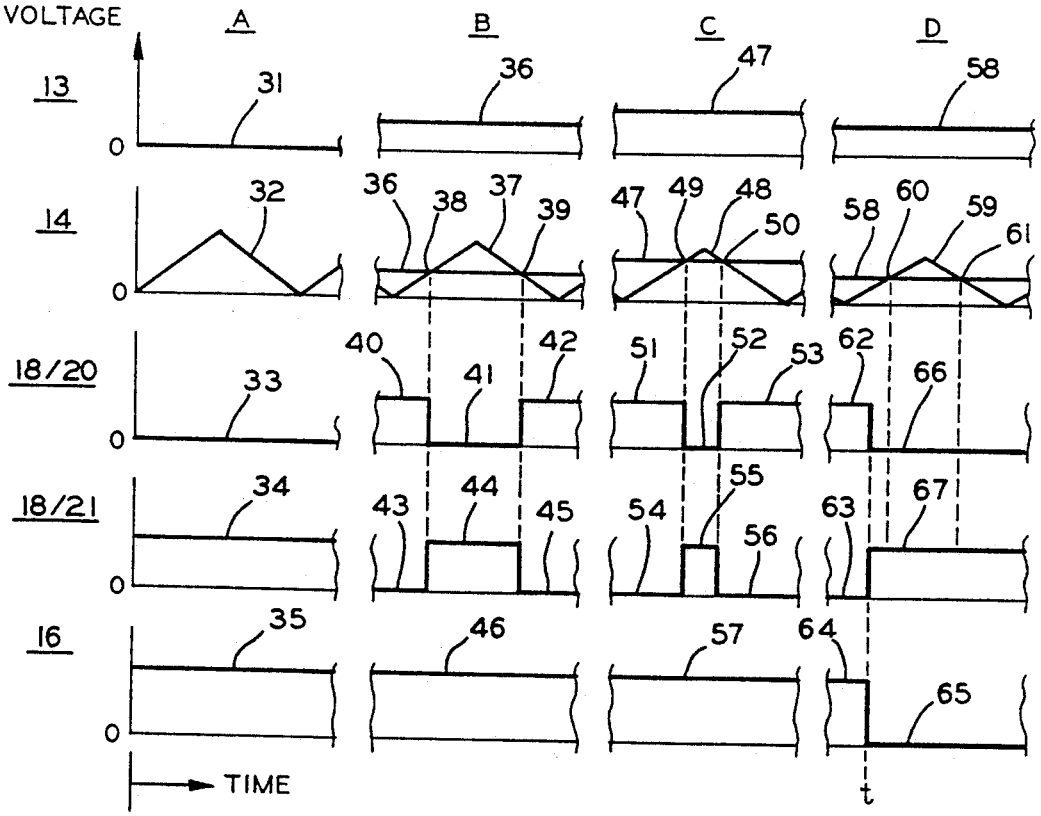
FIG. 2 is wave form diagram of signals generated by the apparatus shown in the FIG. 1.

There is shown in the FIG. 2 voltage level versus time wave forms generated in the system 11 of the FIG. 1. Across the top of the FIG. 2, four time periods are identified from left to right as "A", "B", "C" and "D". At the left side of the FIG. 2, five wave forms are identified from top to bottom by the reference numerals 13, 14, 18/20, 18/21 and 16. The upper wave form is the demand signal generated on the line 13. The next wave form is triangle shaped and is generated in the controller 14. The next two wave forms are switch signals generated at the outputs of the driver 18 to the gates of the FETs 20 and 21. The lower wave form is the crash sensor crash detection signal generated on the line 16.

During the first time period "A", a first portion 31 of the demand signal on the line 13 is at a zero voltage level representing no demand for fuel such when the vehicle ignition has been turned on but the engine has not been started. The controller 14 internally generates a triangle shaped wave as shown by a first portion 32 thereof. The controller 14 sums the wave forms 31 and 32 and generates a pulse width modulated control signal to the driver 18 for switching the FETs 20 and 21. The pulse width modulation is based upon the points at which the demand signal crosses the triangle wave form and, since the signal on the line 13 is a zero, no modulation occurs. The driver 18 generates a first portion 33 switch signal wave form at a zero voltage level to maintain the FET 20 turned off and block power to the motor 23. The driver 18 also generates a first portion 34 switch signal at a maximum voltage level to turn on the FET 21 and short circuit the armature of the motor 23. At the same time, the crash sensor 15 generates a first portion crash detection signal wave form 35 on the line 16 at a maximum voltage level representing a "no crash sensed" condition.

During the second time period "B", the demand sensor 12 generates a second portion demand signal wave form 36 at a medium voltage level representing the fuel demand, for example, at a cruising speed for the vehicle. The wave form 36 is summed with a second portion triangle wave form 37 in the controller 14. The second portion wave form 36 crosses the second portion triangle wave form 37 at a first intersection 38 and a second intersection 39. Prior to the intersection 38, the wave form 36 is greater in magnitude than the wave form 37 causing the controller 14 and the driver 18 to generate a switch signal portion 40 at a voltage level which turns on the FET 20 and provides electrical power to operate the motor 23. Between the points 38 and 39, the wave form 36 is lower in magnitude than the wave form 37 and a switch signal portion 41 is generated at a zero voltage level to turn off the FET 20. At the intersection 39, the wave form 36 again is greater than the magnitude of the wave form 37 and a switch signal portion 42 is generated at a voltage level which turns on the FET 20. Thus, as the voltage level of the second portion wave form 36 changes in accordance with the fuel demand, the relative lengths of the signal portions 40, 41 and 42 will vary providing pulse width modulated control of the speed of the motor 23. The controller 14 and the driver 18 operate in a similar manner to generate switch signal portions 43, 44 and 45 to control the FET 21 in the opposite sense from the FET 20. During the second time period "B", the crash sensor 15 generates a second portion crash detection signal wave form 46 on the line 16 at a maximum voltage level representing a "no crash sensed" condition.

During the third time period "C", the demand sensor 12 generates a third portion demand signal wave form 47 at a high voltage level representing the fuel demand, for example, during start up and high rate acceleration. The wave form 47 is summed with a third portion triangle wave form 48 in the controller 14. The third portion wave form 47 crosses the third portion triangle wave form 48 at a first intersection 49 and a second intersection 50. Prior to the intersection 49, the wave form 47 is greater in magnitude than the wave form 48 causing the controller 14 and the driver 18 to generate a switch signal portion 51 at a voltage level which turns on the FET 20 and provides electrical power to operate the motor 23. Between the points 49 and 50, the wave form 47 is lower in magnitude than the wave form 48 and a switch signal portion 52 is generated at a zero voltage level to turn off the FET 20. At the intersection 50, the wave form 47 again is greater than the magnitude of the wave form 48 and a switch signal portion 53 is generated at a voltage level which turns on the FET 20. Thus, as the voltage level of the demand signal on the line 13 increased from the time period "B" to the time period "C" representing increased fuel demand, the relative lengths of the signal portions 51, 52 and 53 increased, decreased and increased respectively as compared to the corresponding signal portions 40, 41 and 42 to provide pulse width modulated control of the speed of the motor 23. The controller 14 and the driver 18 operate in a similar manner to generate switch signal portions 54, 55 and 56 to control the FET 21 in the opposite sense from the FET 20. During the third time period "C", the crash sensor 15 generates a third portion crash detection signal wave form 57 on the line 16 at a maximum voltage level representing a "no crash sensed" condition.

During the fourth time period "D", the demand signal on the line 13 is at a medium voltage level represented by a fourth portion wave form 58. The fourth portion wave form 58 crosses a fourth portion triangle wave form 59 at a first intersection 60 and a second intersection 61 and the controller 14 and the driver 18 normally would generate the switch signal portions shown in the second time period "B". A first switch signal portion 62 would be generated to turn on the FET 20 and a first switch signal portion 63 would be generated to turn off the FET 21. However, at a time "t" before the first intersection 60, the crash detection signal on the line 16 falls from a maximum voltage level signal portion 64 to a zero level signal portion 65 indicating the a "crash" condition has been sensed. The controller 14 responds to this signal change by terminating the pulse width modulated control signals and generating a switch signal portion 66 at a zero voltage level to turn off the FET 20 and a switch signal portion 67 at a maximum voltage level to turn on the FET 21 thereby terminating power to the fuel pump motor 23 and stopping the flow of fuel to the engine of the vehicle.

Figure 3:
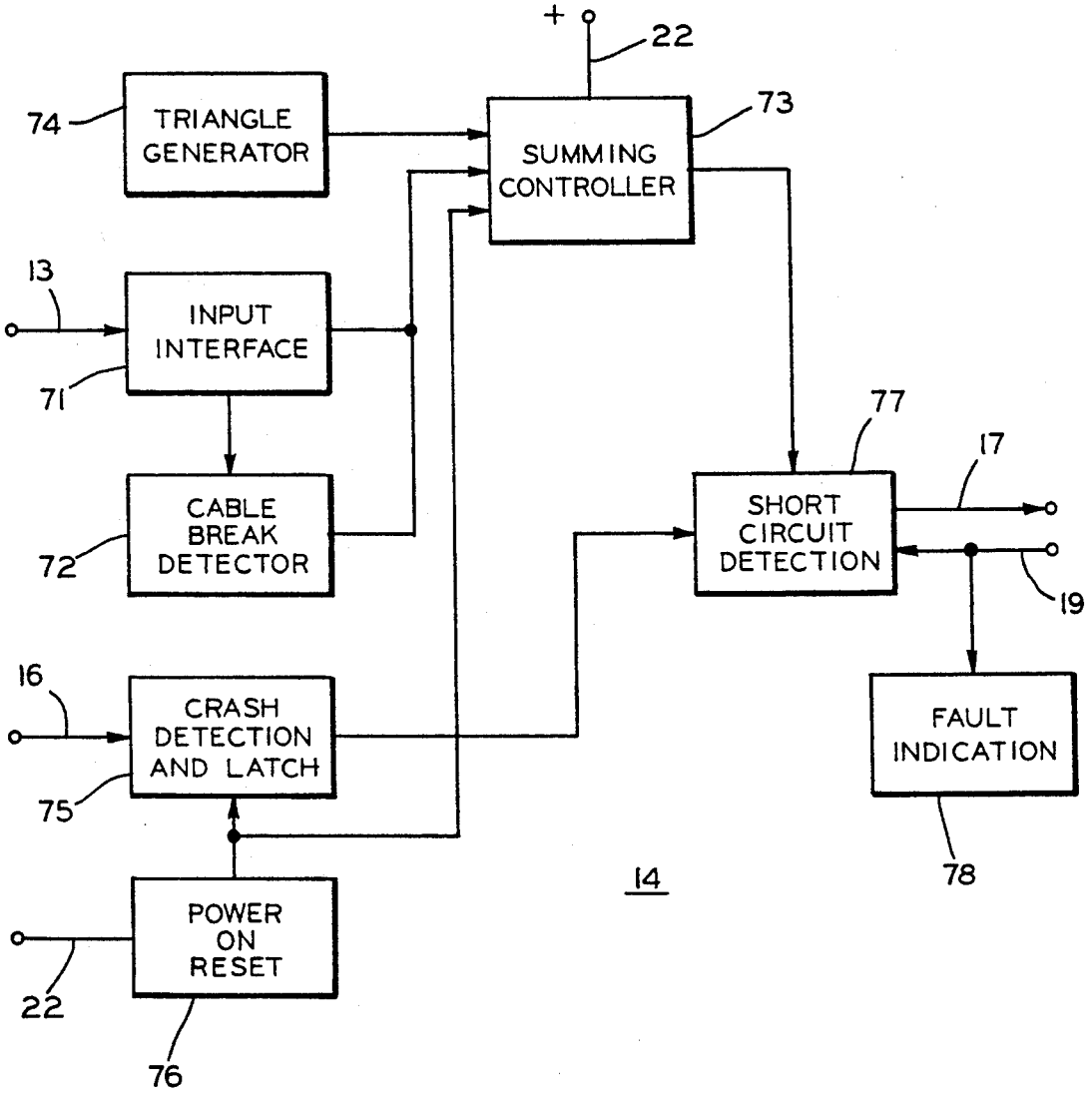
FIG. 3 is a schematic block diagram of the controller shown in the FIG. 1.

The controller 14 of the FIG. 1 is shown in more detail in the block diagram of the FIG. 3. The first line 13 is connected to the output of the demand sensor 12 of the FIG. 1 and the first input of the controller 14 which is an input terminal of an input interface circuit 71. The input interface 71 has a first output connected to an input of a cable break detector circuit 72. A second output of the input interface 71 and an output of the cable break detector 72 are both connected to a first input of a summing controller 73. A triangle generator 74 has an output connected to a second input of the summing controller 73.

The second line 16 is connected between the crash sensor 15 of the FIG. 1 and the second input of the controller 14 which is a first input of a crash detection and latch circuit 75. The crash detection and latch 75 has a second input connected to an output of a power on reset circuit 76. The output of the power on reset 76 is also connected to a third input of the summing controller 73. An input of the power on reset 76 is connected to the power supply line 22 as is the fourth input to the controller 14 which is also a fourth input to the summing controller 73.

The summing controller 73 has an output connected to a first input of a short circuit detection circuit 77. The crash detection and latch 75 has an output connected to a second input of the short circuit detection 77. A third input of the short circuit detection 77 is the third input to the controller 14 and is connected to the fourth line 19 which is also connected to an input of a fault indication circuit 78. An output of the short circuit detection 77 is connected to the third line 17, the third line 17 and the fourth line 19 being connected to the driver 18 as shown in the FIG. 1.

As stated above, one or more demand sensors 12 can generate a demand signal on the first line 13 representing the fuel requirement for the vehicle. The input interface 71 receives the demand signal and outputs it to the summing controller 73. The triangle generator 74 generates a triangularly shaped wave form which is summed with the demand signal as shown in the FIG. 2. If we assume that the base of the triangle represents one complete cycle of the control signal generated on the third line 17, then the points at which the demand signal matches the magnitude of the triangular wave form, on the rising and falling sides thereof, can be used to trigger on and off the control signal thereby generating a pair of complementary duty cycled or pulse width modulated switch signals for the FET switches. Furthermore, the control 14 takes into account the magnitude the power supply voltage. The voltage generated by a vehicle battery can vary within a predetermined range. As the magnitude of such voltage increases, the motor 23 will rotate faster thereby increasing the fuel flow. The summing controller 73 is connected to the power supply line 22 to sense the battery voltage and compensate for fluctuations therein by adjusting the duty cycle of the switch signal to compensate for increases or decreases in the speed of the motor 23 caused by fluctuations in the battery voltage.

The controller 14 also functions to detect a vehicle crash and switch off the fuel pump. The crash sensor 15 can be, for example, a model 512 inertia switch available from First Switch, Inc. of Grand Blanc, Mich. A crash detection signal from the crash sensor 15 is generated as an input on the second line 16 to the crash detection and latch 75. The circuit 75 generates an output signal which is latched at the input to the short circuit detection 77. The short circuit detection 77 responds to the crash detection and latch 75 output signal by clamping the third line 17 at zero voltage thereby turning off the transistor 20 and blocking power to the motor 23. Thus, the fuel pump is switched off until the crash detection and latch circuit 75 is reset by the power on reset circuit 76. At the same time, the transistor 21 can be turned on to short circuit the motor armature and quickly stop the motor 23 thereby reducing the amount of fuel pumped after a crash occurs.

The cable break detector circuit 72 senses a failure in the input signal on the first line 13 and signals the summing controller 73 to generate the switch signal with a one hundred percent duty cycle to operate the fuel pump motor 23 at maximum speed for maximum fuel pressure.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for controlling a fuel pump electric motor powered from a direct current power source comprising:

a first input line for receiving a demand signal representing a fuel flow demand of a vehicle engine;

a controller having a first input connected to said first input line and an output and being responsive to said demand signal for generating a pulse width modulated control signal at said controller output;

a crash sensor for sensing a crash condition for a vehicle and having an output for generating a crash detection signal representing a crash condition and a second input line connected to said crash sensor output and wherein said controller has a second input connected to said second input line;

a driver having an input connected to said controller output and an output and being responsive to said control signal for generating a switch signal at said driver output; and a switch having a gate input connected to said driver output, a power input and a power output whereby when said switch power input is connected to a direct current power supply and said switch power output is connected to a direct current fuel pump electric motor, said switch controls the speed of said motor in response to said demand signal, and wherein said controller is responsive to said crash detection signal for turning off said switch when said crash sensor senses a crash.

2. The apparatus according to claim 1 wherein said driver output is a first output and said driver has a second output and in response to said control signal said driver generates a first switch signal at said first output and a second switch signal at said second output and wherein said switch includes a first field effect transistor having a gate connected to said first driver output and a second field effect transistor having a gate connected to said second driver output whereby said driver turns said first and second transistors on and off alternately.

3. The apparatus according to claim 2 wherein said first transistor is connected is series with an armature of said fuel pump electric motor and said second transistor is connected in parallel with said armature.

4. The apparatus according to claim 1 including a demand sensor for sensing a fuel flow demand condition for a vehicle and having an output connected to said first input line for generating said demand signal.

5. The apparatus according to claim 1 wherein said crash sensor is an inertia switch.

6. The apparatus according to claim 1 wherein said driver output is a first output and said driver has a second output and in response to said control signal said driver generates a first switch signal at said first output and a second switch signal at said second output and wherein said switch includes a first field effect transistor having a gate connected to said first driver output and a second field effect transistor having a gate connected to said second driver output whereby said driver turns off said first transistor and turns on said second transistor when said crash sensor senses a crash.

7. An apparatus for controlling a fuel pump electric motor powered from a direct current power source comprising:

a demand sensor for sensing a fuel flow demand condition for a vehicle engine and having an output for generating a demand signal representing a fuel flow demand;

a crash sensor for sensing a crash condition and having an output for generating a crash detection signal representing said crash condition;

a controller having a first input connected to said demand sensor output and an output and being responsive to said demand signal for generating a pulse width modulated control signal at said controller output and having a second input connected to said crash sensor output and being responsive to said crash detection signal for turning off said control signal when a crash occurs;

a driver having an input connected to said controller output and an output and being responsive to said control signal for generating a switch signal at said driver output; and a switch having a gate input connected to said driver output, a power input and a power output whereby when said switch power input is connected to a direct current power supply and said switch power output is connected to a direct current fuel pump electric motor, said switch controls the speed of said motor in response to said demand signal.

8. The apparatus according to claim 7 wherein said driver output is a first output and said driver has a second output and in response to said control signal said driver generates a first switch signal at said first output and a second switch signal at said second output and wherein said switch includes a first field effect transistor having a gate connected to said first driver output and a second field effect transistor having a gate connected to said second driver output whereby said driver turns said first and second transistors on an off alternately.

9. The apparatus according to claim 8 wherein said first transistor is connected is series with an armature of said fuel pump electric motor and said second transistor is connected in parallel with said armature.

10. An apparatus for controlling a fuel pump electric motor powered from a direct current power source comprising:

a first line for receiving a demand signal representing a fuel flow demand;

a triangle generator having an output for generating a triangle shaped signal;

a summing controller having a first input connected to said first line, a second input connected to said triangle generator output and an output and being responsive to said demand signal and said triangle shaped signal for generating a pulse width modulated control signal at said controller output;

an input interface circuit having an input connected to said first line and a first output connected to said controller first input for applying said demand signal to said controller first input and having a second output;

a cable break detector having an input connected to said input interface circuit second output and an output connected to said first input of said summing controller;

a driver having an input connected to said controller output and a pair of outputs and being responsive to said control signal for generating a pulse width modulated switch signal at each of said driver outputs, said switch signals being complementary; and a pair of switches each having a gate input connected to one of said driver outputs whereby said switches are switched on and off alternately in response to said switch signals.

11. The apparatus according to claim 10 including a second line for receiving a crash detection signal representing a crash condition and wherein said summing controller has a third input connected to said second line and is responsive to said crash detection signal for terminating pulse width modulation of said control signal.

12. The apparatus according to claim 11 including a crash detection and latch circuit having a first input connected to said second line and an output and including a short circuit detection circuit having a first input connected to said controller output, a second input connected to said crash detection and latch circuit output and an output connected to said driver input for applying said control signal to said driver.

13. The apparatus according to claim 10 including a crash sensor for sensing a crash condition for a vehicle and having an output for generating a crash detection signal representing said crash condition and a second input line connected to said crash sensor output and wherein said summing controller second input is connected to said second input line and is responsive to said crash detection signal for turning off one of said switches when said crash sensor senses a crash.

14. The apparatus according to claim 13 wherein said summing controller is responsive to said crash detection signal for turning on another one of said switches.

15. The apparatus according to claim 13 wherein said crash sensor is an inertia switch.

* * * * *